US006302722B1

(12) United States Patent
Simmel

(10) Patent No.: US 6,302,722 B1
(45) Date of Patent: Oct. 16, 2001

(54) MATING/UNMATING SYSTEM FOR ELECTRICAL CONNECTORS

(75) Inventor: George M. Simmel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 09/708,896

(22) Filed: Nov. 8, 2000

(51) Int. Cl.[7] ..... H01R 13/64
(52) U.S. Cl. ..... 439/374
(58) Field of Search ..... 439/374, 680, 439/357, 566, 570, 74

(56) References Cited

U.S. PATENT DOCUMENTS

| | | | | |
|---|---|---|---|---|
| 4,986,765 | | 1/1991 | Korsunsky et al. | 439/326 |
| 5,120,256 | | 6/1992 | Walden | 439/553 |
| 5,472,354 | * | 12/1995 | Chen et al. | 439/357 |
| 5,885,088 | | 3/1999 | Brennan et al. | 439/680 |
| 6,074,230 | | 6/2000 | Comerci et al. | 439/284 |
| 6,146,210 | * | 11/2000 | Cha et al. | 439/680 |

* cited by examiner

*Primary Examiner*—Brian Sircus
*Assistant Examiner*—Javaid Nasri
(74) *Attorney, Agent, or Firm*—Stephen Z. Weiss

(57) ABSTRACT

An electrical connector assembly includes a first connector having a dielectric housing and a receptacle extending in a given mating direction. A second connector is mateable with the first connector in the given mating direction and includes a dielectric housing having an alignment rib positionable in said receptacle when the connectors are mated. The receptacle includes at least one flexible wall allowing the connectors to be unmated and the alignment rib to move out of the receptacle at an angle to the given mating direction.

10 Claims, 4 Drawing Sheets

MATING/UNMATING SYSTEM FOR ELECTRICAL CONNECTORS

FIELD OF THE INVENTION

This invention generally relates to the art of electrical connectors and, particularly, to a system for facilitating mating and unmating of a pair of connectors.

BACKGROUND OF THE INVENTION

A typical electrical connector assembly includes a pair of electrical connectors which are mateable to interengage conductive terminals on the connectors to establish electrical circuits through the connector interface. Each connector typically includes a dielectric housing within which the terminals are mounted. The connectors are mateable in a given mating direction.

The mating connectors of a connector assembly often have some form of alignment system to facilitate aligning the connectors during mating. An example is in a holding frame or cradle and a portable data entry device. One connector of the connector assembly is mounted on the holding frame or cradle, and the other connector of the assembly is mounted on the portable data entry device. The holding frame has what is called a "docking port" for receiving the portable data entry device. It is desirable to provide some form of alignment system to guide the portable data entry device in the docking port of the holding frame to maintain the electrical connectors in proper alignment during mating. However, the portable data entry device must be able to easily be removed from the docking port of the holding frame, and this creates a dilemma. During mating, users are more careful in attempting to insert the portable data entry device into the docking port, and the alignment system can be fairly rigid for these purposes. On the other hand, users quite rapidly and less carefully pull the portable data entry device out of the docking port and at angles to the given mating direction. Often, the removing or unmating forces are excessive. Repeated cycles of use of the device or a single undue use of excessive forces at angles to the given mating direction often causes damage to the components. The present invention is directed to solving these problems by providing an alignment system in which the connectors can be easily aligned for mating in a given direction but allows for ready removal or unmating of the connectors at an angle to the given mating direction.

SUMMARY OF THE INVENTION

An object, therefore, of the invention is to provide a new and improved mating and unmating system between a pair of connectors of an electrical connector assembly.

In the exemplary embodiment of the invention, the connector assembly includes a first connector having a dielectric housing for mounting a plurality of terminals. Means for aligning the connectors on the housing extend in a given mating direction. A second connector includes a dielectric housing for mounting a plurality of terminals, and second connector is mateable with the first connector in the given mating direction. Receptacles are provided on the housing of the second connector for receiving the alignment means on the housing of the first connector when the connectors are mated. The receptacles include at least one flexible wall allowing the connectors to be unmated and the alignment means to move out of the receptacle means at an angle to the given mating direction.

As disclosed herein, the receptacles are provided by a groove extending in the mating direction. The groove is open-sided transversely of the mating direction. The alignment means is provided by a rib extending in the mating direction.

The dielectric housings of the first and second connectors may be fabricated of molded plastic material. In the preferred embodiment, the alignment means and the receptacles on the first and second connectors, respectively, are provided on separate metal clips mounted on the respective connector housings. The metal clips not only compensate for wear on the connectors, but good flexing action is provided for the flexible wall of the receptacle means on the second connector which receives the alignment means on the first connector.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the figures and in which:

DETAILED DESCRIPTION OF THE PREFERRED EMBODIMENT

Figures 1, 2:
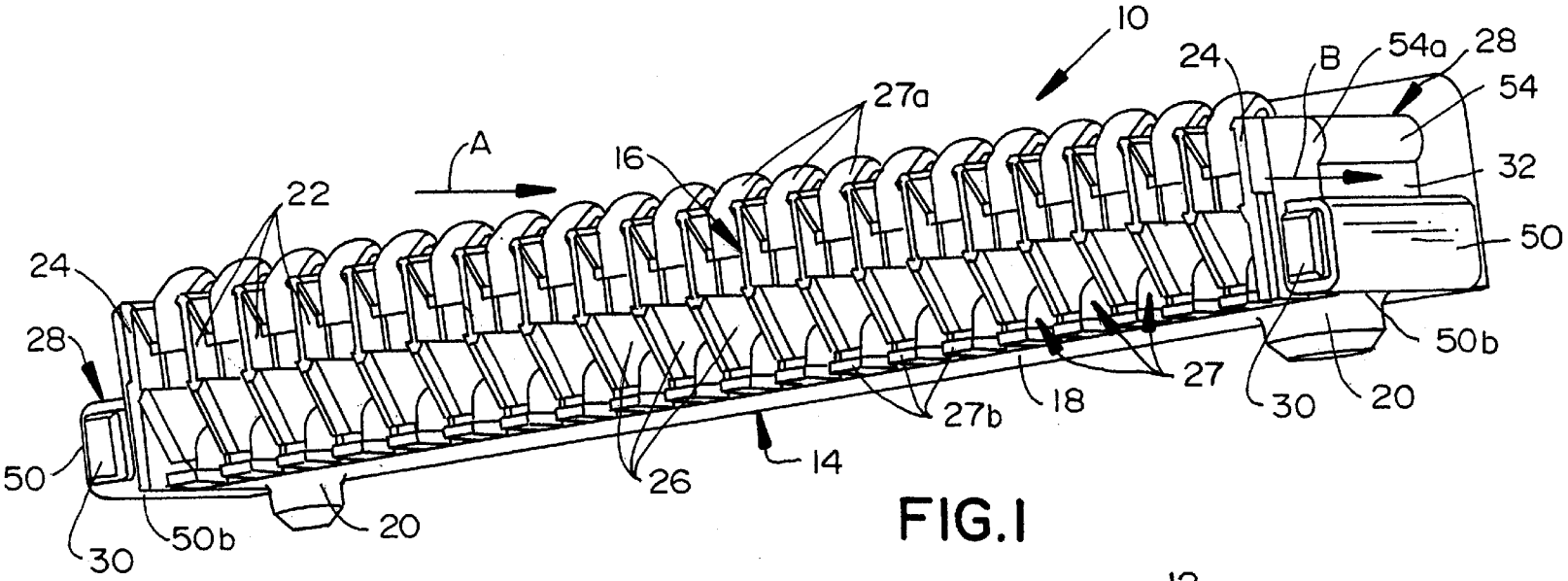
FIG. 1 is a bottom perspective view of the first or cradle connector incorporating the alignment means of the invention.
FIG. 2 is a perspective view of the second or device connector incorporating the concepts of the invention.

Referring to the drawings in greater detail, and first to FIGS. 1 and 2, the invention is embodied in an electrical connector assembly which includes a first connector, generally designated 10 (FIG. 1), and a second connector, generally designated 12 (FIG. 2). The second connector is mateable with the first connector in the direction of arrow "A" (FIG. 1). Although the invention is equally applicable for a wide range of different types of electrical connectors, first connector 10 is of a type used in a docking port or "cradle" of a holding frame and will be called hereinafter the "cradle" connector 10. Second connector 12 is of a type used in a portable data entry device which is inserted and removed from the docking port and will be called hereinafter the "device" connector 12.

With that understanding and still referring to FIG. 1, cradle connector 10 includes an elongated dielectric housing, generally designated 14, which includes a mating face, generally designated 16, and a bottom mounting face 18. A pair of mounting posts 20 project downwardly from the bottom face for mounting the connector on a printed circuit board. A plurality of partition walls 22 are spaced between a pair of end walls 24 to define a plurality of terminal-receiving passages 26 therebetween. A plurality of terminals, generally designated 27, are mounted in passages 26. The terminals include contact portions 27*a* and tail portions 27*b* for connection to circuit pads on the printed circuit board. As will be described in greater detail hereinafter, a receptacle clip, generally designated 28, is press-fit over a rectangular, elongated mounting post 30 which is integral with and projects outwardly from each end wall 24. Housing 14 may be a one-piece structure molded of dielectric material such as plastic or the like. Receptacle clips 28 define grooves 32 on the outsides thereof, with the grooves extending in the direction of arrow "B" generally parallel to mating direction "A".

Referring to FIG. 2, device connector 12 includes a one-piece molded plastic housing, generally designated 34, having a pair of mounting posts 36 projecting therefrom for mounting the connector on a second printed circuit board. The housing includes a plurality of partition walls 38 spaced between a pair of end walls 40 to define a plurality of passages therebetween which receive a plurality of terminals, generally designated 42, individually between the partition walls. The terminals have contact portions 42*a* for engaging contact portions 27*a* of terminals 27 of cradle connector 10. An alignment clip, generally designated 44, is mounted on the inside of each end wall 40 and includes an elongated alignment rib 46 which extends in the direction of arrows "B" generally parallel to mating direction "A" (FIG. 1). In other words, arrows "B" in FIGS. 1 and 2 are coincident, and alignment ribs 46 of alignment clips 48 on device connector 12 move into grooves 32 of receptacle clips 28 on cradle connector 10 when the connectors are mated. The ribs and grooves facilitate proper alignment of the connectors during mating.

Figure 3:
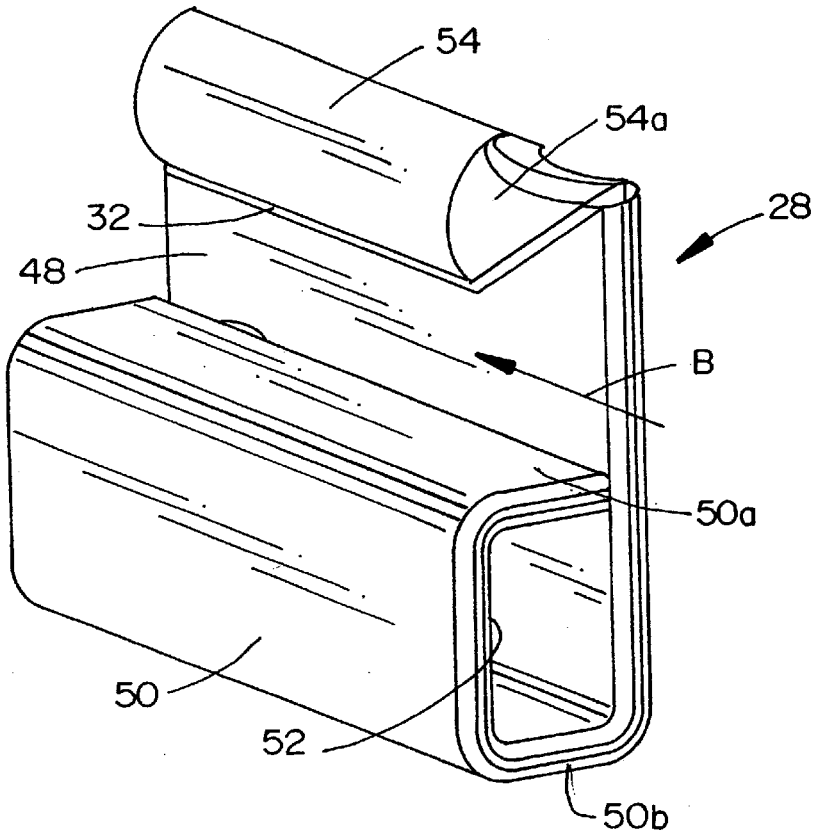
FIG. 3 is an outside perspective view of one of the receptacle clips at opposite ends of the cradle connector of FIG. 1.
Figure 4:
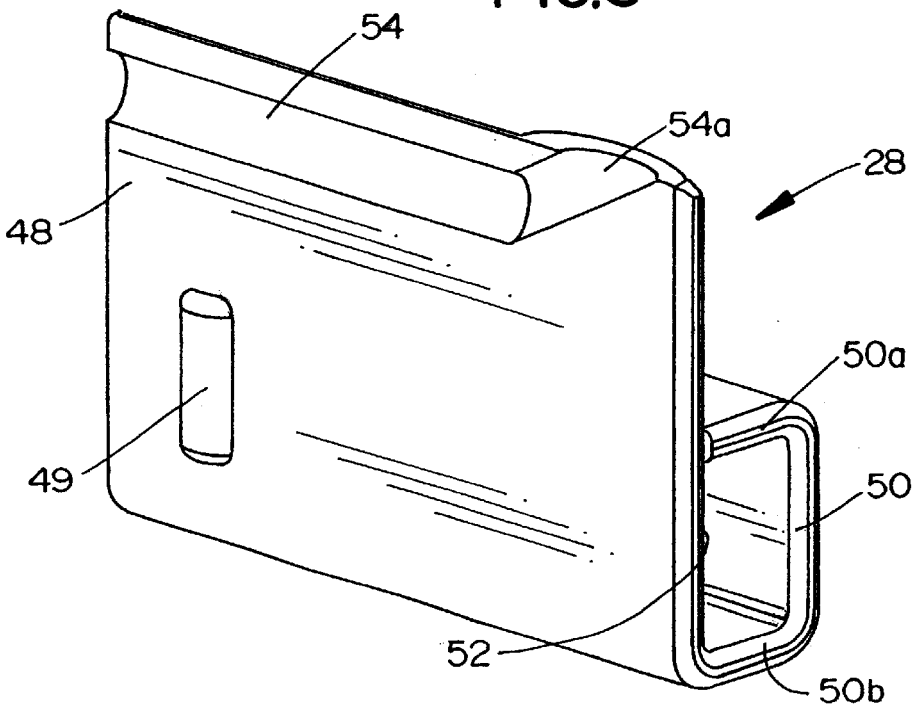
FIG. 4 is an inside perspective view of the receptacle clip.

Referring to FIGS. 3 and 4 in conjunction with FIG. 1, as stated above, each receptacle clip 28 includes a groove 32 which extends in the direction of arrow "B" for receiving the alignment rib 46 on one of the alignment clips 44. Each receptacle clip is stamped and formed of sheet metal material and includes a generally flat base plate 48 which abuts against the outside of one of the end walls 24 (FIG. 1) of cradle connector housing 14. Each receptacle clip includes a locking boss 49 so that the clip is press-fit between one of the end walls 24 and adjacent mounting post 30. A generally rectangular tube 50 defines a through hole 52 for sliding onto one of the posts 30 of cradle connector housing 14 to establish a press-fit therewith. Rectangular tube 50 defines opposite side walls 50*a* and 50*b*. A rounded flange 54 is formed from base plate 48 on the same side thereof as rectangular tube 50. Therefore, groove 32 is defined between side wall 50*a* of tube 50 and rounded flange 54. An end 54*a* of rounded flange 54 is frusto-conical to define a diverging mouth to guide alignment rib 46 (FIG. 2) of one of the alignment clips 44 into groove 32. Finally, side wall 50*b* of rectangular tube 50 of each receptacle clip 28 is generally flush with bottom face 18 of cradle connector housing 14 as seen in FIG. 1. Therefore, walls 50*b* of receptacle clips 28 can be soldered to metal pads on the printed circuit board, whereby clips 28 perform a dual function of facilitating alignment and mating of the connectors as well as holding cradle connector 10 securely to the printed circuit board.

Figure 5:
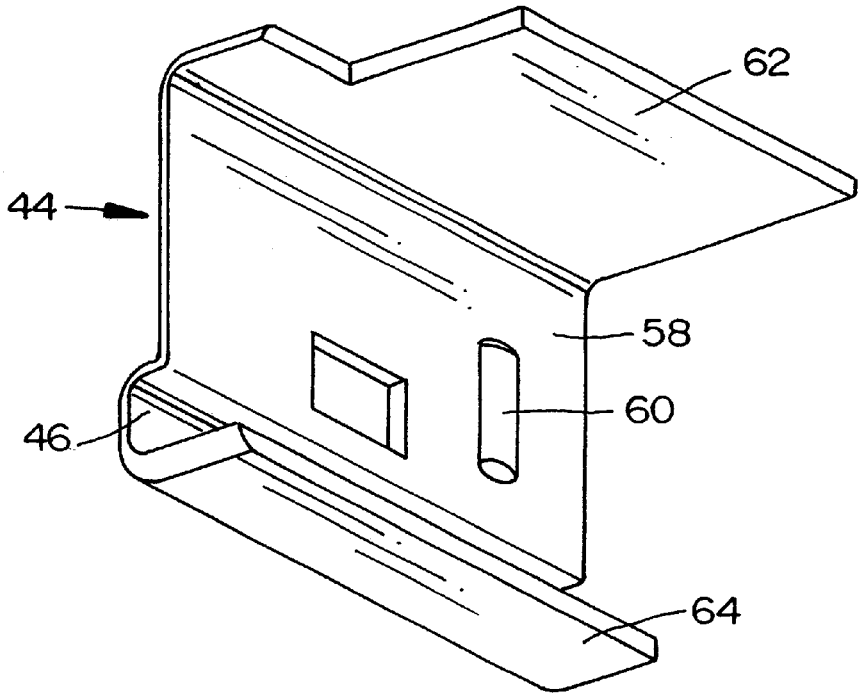
FIG. 5 is an outside perspective view of one the alignment clips at opposite ends of the device connector of FIG. 2.
Figure 6:
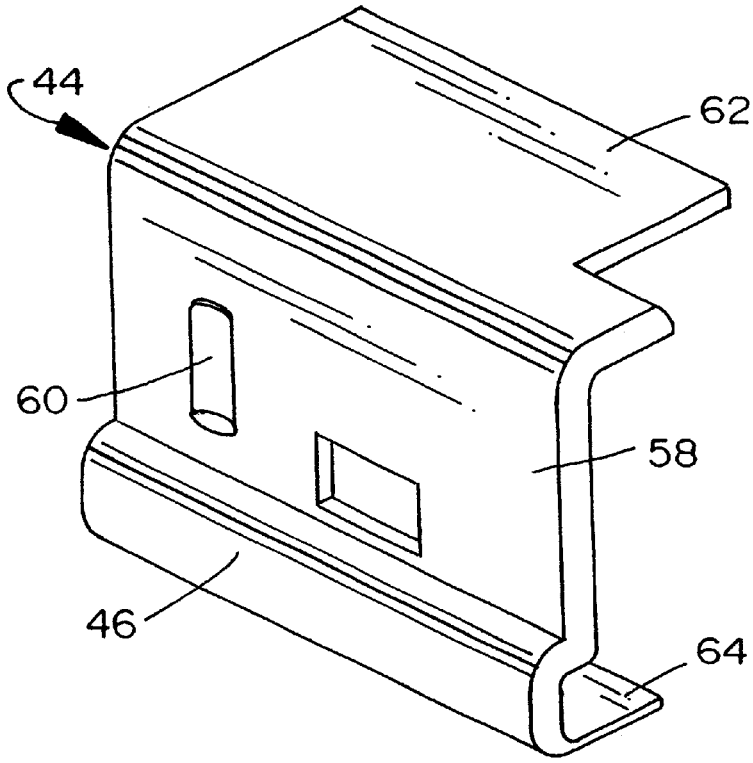
FIG. 6 is an inside perspective view of the alignment clip.

Referring to FIGS. 5 and 6 in conjunction with FIG. 2, each alignment clip 44 includes a base plate 58 which is inserted between one of the end walls 40 of device connector housing 34 and an inside wall 59 (FIG. 2) of the housing. The alignment clips are stamped and formed of sheet metal material, and base plate 58 has a locking boss 60 stamped therefrom to lock the clip to housing 34. In essence, locking bosses 60 of clips 44 are press-fit between end walls 40 (FIG. 2) and walls 59 of connector housing 34.

Each alignment clip further includes a planar flange 62 formed along one edge of base plate 58, with rib 46 formed along the opposite edge of the base plate. Rib 46 is formed, in part, by a flange 64. As seen in FIG. 2, flanges 64 of alignment clips 44 are juxtaposed against edges of end walls 40, while planar flanges 62 are disposed about a mounting face 66 of connector housing 34 for connection, as by soldering, to mounting pads on the printed circuit board to which device connector 12 is mounted. Therefore, like receptacle clips 28, alignment clips 44 perform dual functions of facilitating alignment and mating of the connectors as well as holding device connector 12 down on its printed circuit board.

Figure 7:
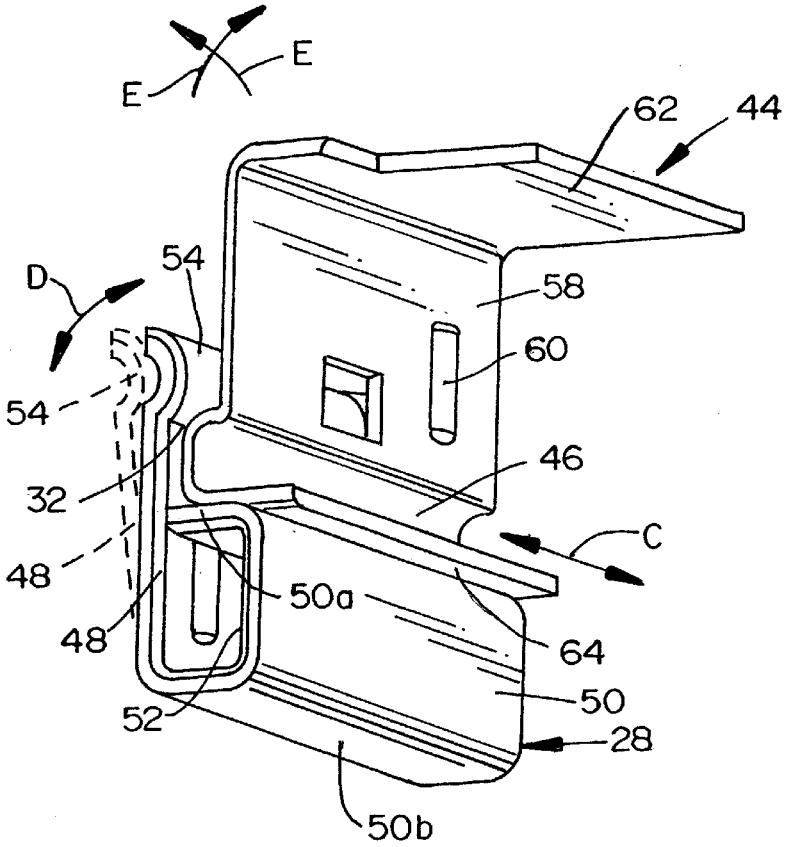
FIG. 7 is a perspective view of the receptacle and alignment clips in mated condition.
Figure 8:
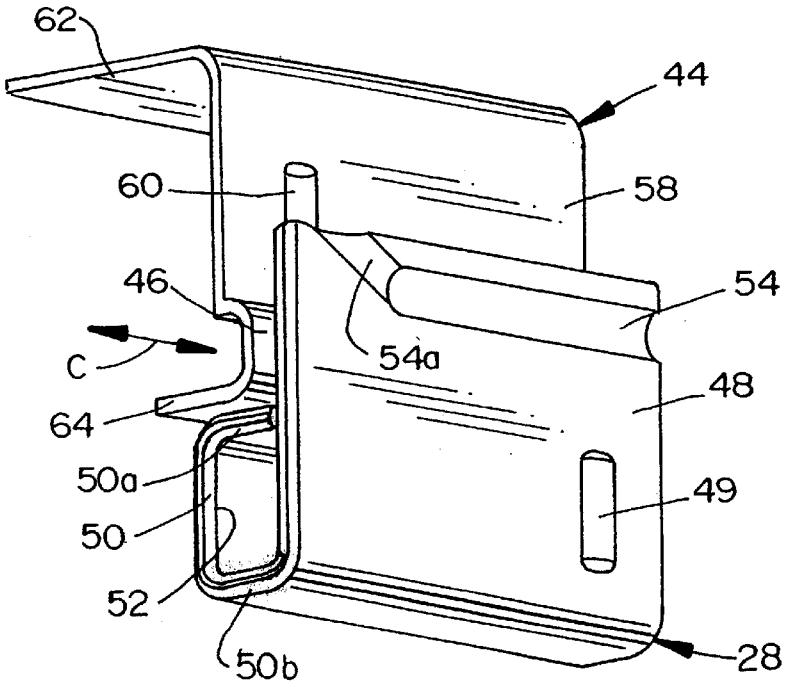
FIG. 8 is a view similar to that of FIG. 7, but looking at the opposite side of the mated receptacle and alignment clips.

FIGS. 7 and 8 show receptacle clips 28 interengaged with alignment clips 44 when connectors 10 and 12 are mated. During mating and unmating of the connectors in mating direction "A" (FIG. 1), ribs 46 of alignment clips 44 slide into and out of grooves 32 in receptacle clips 28 as indicated by double-headed arrows "C" (FIGS. 7 and 8). A unique feature of the invention is that base plate 48 of each receptacle clip 28 can flex in the direction of double-headed arrow "D" (FIG. 7). Base plate 48 and rounded flange 54 are shown in FIG. 7 having been moved to a flexed position shown in dotted lines. Therefore, if device connector 12 with its alignment clips 44 are unmated from cradle connector 10 and its receptacle clips 28 at angles to mating direction "A" (FIG. 1) or "C" (FIG. 7) as indicated by angled arrows "E" in FIG. 7, which arrows are in a plane parallel to the plane of base plate 58 of the alignment clips 44, base plates 48 of receptacle clips 28 simply will flex outwardly and allow the connectors to be unmated. This yieldability of the receptacle clip prevents damage to the components when attempts are made to unmate the connectors at an angle to the preferred mating direction "A" of the connectors.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a first connector including a dielectric housing for mounting a plurality of terminals and a receptacle extending in a given mating direction; and a second connector including a dielectric housing for mounting a plurality of terminals, the second connector being matable with the first connector in said given mating direction, and means for aligning the second connector, said aligning means being positionable in said receptacle when the connectors are mated;

the receptacle including at least one flexible wall allowing the connectors to be unmated and allowing the alignment means to move out of the receptacle at an angle to said given mating direction, the flexible wall including a groove extending in the mating direction and being open-sided transversely of the mating direction.

2. The electrical connector assembly of claim 1 wherein said alignment means comprises a rib extending in said mating direction.

3. The electrical connector assembly of claim 1, wherein said receptacle is a metal clip mounted on the dielectric housing of the first connector.

4. The electrical connector assembly of claim 3 wherein said metal clip includes a portion for securing to a printed circuit board, whereby the metal clip performs a dual function of facilitating alignment of the connectors during mating as well as holding the first connector onto the printed circuit board.

5. The electrical connector assembly of claim 1, wherein said receptacle is a metal clip mounted on the dielectric housing of the second connector, said alignment means being on the metal clip.

6. The electrical connector assembly of claim 5, including a second receptacle, said second receptacle being a second metal clip mounted on the dielectric housing of the first connector.

7. The electrical connector assembly of claim 5 wherein said metal clip includes a portion for securing to a printed circuit board, whereby the metal clip performs a dual function of facilitating alignment of the connectors during mating as well as holding the second connector onto the printed circuit board.

8. An electrical connector assembly, comprising:

a first connector including a dielectric housing for mounting a plurality of terminals, and a first metal clip mounted on the dielectric housing and including a groove extending in a given mating direction;

a second connector including a dielectric housing for mounting a plurality of terminals, the second connector being mateable with the first connector in said given mating direction, and a second metal clip mounted on the dielectric housing of the second connector and including a rib extending in the mating direction for positioning in said groove when the connectors are mated; and said groove being in a flexible wall of the first metal clip for allowing the first and second connectors to be unmated and the rib to move out of the groove at an angle to said given mating direction.

9. The electrical connector assembly of claim 8 wherein the dielectric housings of the first and second connectors are elongated and include opposite ends, and including one first metal clip at each opposite end of the housing of the first connector and one second metal clip at each opposite end of the housing of the second connector.

10. The electrical connector assembly of claim 8 wherein said metal clips have portions thereof for soldering to respective printed circuit boards, whereby the metal clips perform dual functions of facilitating alignment and mating of the connectors as well as mounting the connectors on respective printed circuit boards.

* * * * *